United States Patent [19]

Smith

[11] 4,335,786

[45] Jun. 22, 1982

[54] OIL WELL PUMPING STRING TUBULAR EXTENSION FOR INCREASING OIL TO SALT WATER RATIO

[76] Inventor: A. Glen Smith, 3801 Tinker Diagonal, Del City, Okla. 73115

[21] Appl. No.: 889,788

[22] Filed: Mar. 23, 1978

[51] Int. Cl.[3] ..... E21B 43/18

[52] U.S. Cl. ..... 166/106; 166/372

[58] Field of Search ..... 166/54.1, 106, 311, 166/312

[56] References Cited

U.S. PATENT DOCUMENTS

| | | | |
|---|---|---|---|
| 1,758,376 | 3/1930 | Sawyer | 166/312 |
| 2,061,865 | 11/1936 | Wells | 166/311 |
| 2,077,911 | 4/1937 | Voorhis | 166/106 |
| 2,618,339 | 11/1952 | Glover | 166/106 X |
| 2,632,513 | 3/1953 | Bennett | 166/106 |
| 3,062,149 | 11/1962 | Jacuzzi | 166/106 |

*Primary Examiner*—William F. Pate, III

*Attorney, Agent, or Firm*—Dunlap & Codding

[57] ABSTRACT

A Venturi type tube is coaxially connected with the depending end of an oil well pumping string for installation in a producing oil well for increasing the ratio of oil to salt water obtained from the well.

3 Claims, 1 Drawing Figure

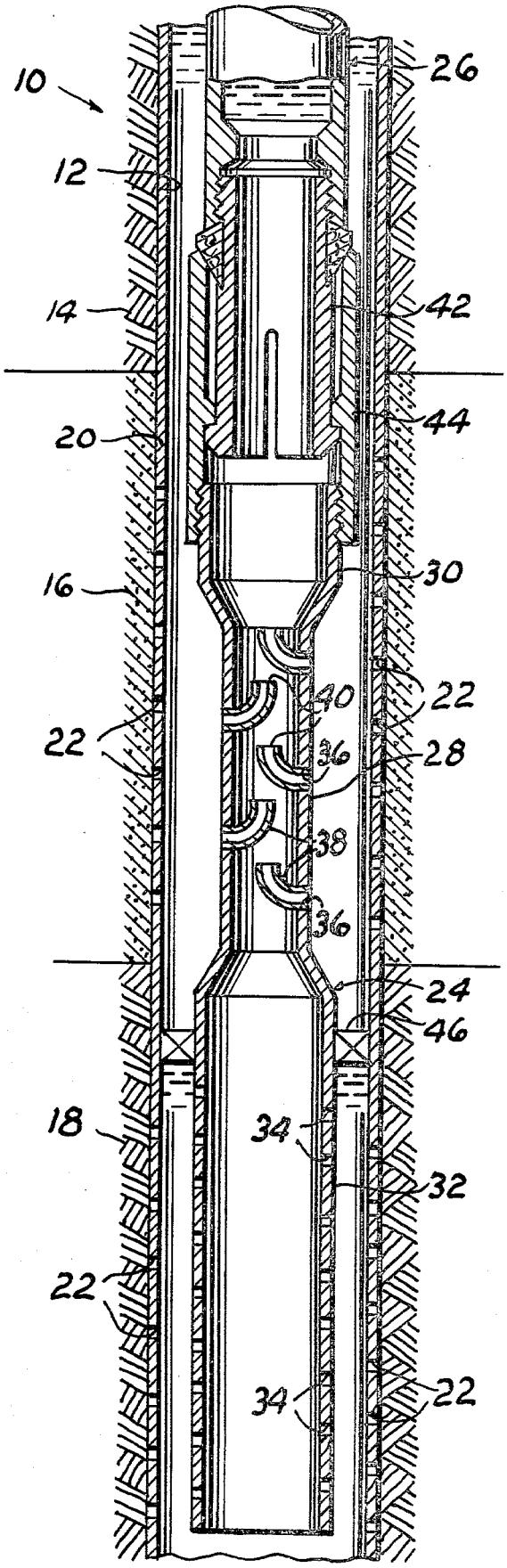
10
12
14
20
16
22
18
22
26
42
44
30
22
28
40
36
38
36
24
46
34
32
34
22

OIL WELL PUMPING STRING TUBULAR EXTENSION FOR INCREASING OIL TO SALT WATER RATIO

BACKGROUND OF THE INVENTION

1. Field of the Invention

The present invention relates to producing oil wells and more particularly to a Venturi type tubular extension coaxially connected to the depending end of an oil well pumping string.

The borehole of an oil well usually extends through an oil producing sand or formation overlying another earth formation containing salt water or a combination of salt water and oil. Casing is usually run into the borehole and thereafter perforated opposite the oil and/or salt water bearing formations.

In producing such a well, such as by using a bottom hole pump, it is necessary that a large quantity of salt water be pumped to the surface with the oil wherein the quantity of salt water greatly exceeds the quantity of oil and the salt water creates a disposal problem.

This invention increases the ratio of oil to salt water above that normally obtained from pumping such a well.

2. Description of the Prior Art

Prior patents generally disclose running a plurality of tubing strings from the surface of the earth to a respective plurality of oil producing formations for simultaneously or separately obtaining oil from the respective formation.

SUMMARY OF THE INVENTION

An elongated tube, having a perforated depending wall and open end, is coaxially connected by its other end with the depending end of a downhole pump equipped tubing string. The elongated tube is characterized by a reduced diameter intermediate its length with the reduced diameter portion having a perforated wall within an inlet tube connected with each inlet perforation in the reduced diameter wall portion. The reduced diameter portion of the tube is disposed opposite an oil producing formation while the depending end of the tube is disposed opposite a salt water and/or oil producing formation. A packer surrounds the elongated tube and seals with the inner wall surface of the well casing wall below the position of the reduced diameter portion of the tube. Thereafter the quantity of oil and/or salt water lifted by the pump generates a Venturi action through the elongated tube thus generating a suction through the perforations of the reduced diameter portion to draw oil into the fluid flowing through the elongated tube.

The principal object is to provide an elongated tubular member to be connected with the depending end of an oil well pumping string for increasing the ratio of salt water to oil normally obtained from an oil and salt water producing borehole.

BRIEF DESCRIPTION OF THE DRAWINGS

The single FIGURE is a vertical cross sectional view, through the depending end of a cased producing well, illustrating the elongated tube attached to the bottom end of the pump equipped tubing string.

DESCRIPTION OF THE PREFERRED EMBODIMENT

Like characters of reference designate like parts in those figures of the drawings in which they occur.

In the drawings:

The reference numeral 10 indicates the depending end portion of a borehole 12 drilled through an earth soil or rock formation 14, an oil bearing sand 16 and a salt water and/or oil producing formation 18. The borehole is provided with a casing 20 passing through the several formations and having a plurality of perforations 22 in its wall opposite the oil and salt water producing formations. An elongated open end tube 24 is connected with the depending end of a bottom hole pump equipped tubing string 26 and run into the casing.

The elongated tube is characterized by an elongated diametrically reduced portion 28 intermediate its upper and lower end portions 30 and 32 with the depending end portion 32 preferably of greater length than the upper portion 30. The wall of the tube bottom portion 32 is provided with a plurality of inlet ports 34. The reduced diameter portion 28 of the tube is similarly provided with inlet ports 36, each having an ell-shaped pipe 38 with one end of the ell disposed within the respective inlet port 36 and its other end 40 turned upwardly and disposed substantially concentric with the longitudinal axis of the tube. Obviously a portion of the pipe end 40 may be flared, not shown, to increase suction at its other end.

The depending end portion of the tubing string 26 is provided with a conventional pump hold-down shoe 42 releasably engaging a pump hold-down 44 threadedly connected with the upper end portion 30 of the tube 24.

A conventional packer 46 surrounds the tube depending end portion 32 between the uppermost one of the perforations 34 and the depending limit of the reduced portion 28. The packer is preferably "set" to seal with the inner wall surface of the casing 20 at a point below the oil producing sand 16.

Obviously another packer, not shown, may be used to form a seal between the tubing string 26 and the inner wall surface of the casing at a selected position above the pump hold-down.

OPERATION

In operation, the pump, not shown, contained by the tubing string 26, draws salt water and/or oil from the formation 18 which, when flowing upwardly through the tube reduced diameter portion 28 and entering the larger end portion 30 of the tube 24, reduces the pressure in the annulus between the reduced diameter portion 28 and the inner wall surface of the casing adjacent the oil producing sand 16 to draw oil in through the ell-shaped pipes 38 to mingle with the fluid passing through the tube 24.

Obviously the invention is susceptible to changes or alterations without defeating its practicability. Therefore, I do not wish to be confined to the preferred embodiment shown in the drawings and described herein.

I claim:

1. In combination with a pump equipped tubing string within a casing for use in conjunction with an oil well having an upper oil producing formation and a lower salt water producing formation, the improvement comprising:

an elongated open end tube coaxially connected with the depending end of said tubing string, the tube having an elongated wall perforated reduced diameter portion intermediate its ends;

a packer surrounding said tube below its reduced diameter portion and sealing with the inside surface of said casing; and at least two open end pipes, each pipe having one end portion secured within one of the perforations in said tube reduced diameter portion and the other open end portion of the pipe being disposed within the opening extending through a portion of the reduced diameter portion of the tube, the fluid passing from the reduced diameter portion of the tube resulting in a pressure reduction causing fluid to be drawn through the perforations in the tube and through the pipes and into the tube opening.

2. The combination of claim 1 wherein the reduced diameter portion of the tube is further defined as being positioned on the tube such that the tube reduced diameter portion is disposed within the upper oil producing formation of the well during the operation.

3. The combination of claim 1 wherein a portion of each pipe, generally near the open end, extends upwardly in a direction substantially coaxial with respect to the longitudinal axis of said tube.

* * * * *